US010863813B2

(12) United States Patent
Davis

(10) Patent No.: US 10,863,813 B2
(45) Date of Patent: Dec. 15, 2020

(54) SEPARABLE NAIL POLISH CONTAINER

(71) Applicant: Seanette Davis, Los Angeles, CA (US)

(72) Inventor: Seanette Davis, Los Angeles, CA (US)

( * ) Notice: Subject to any disclaimer, the term of this patent is extended or adjusted under 35 U.S.C. 154(b) by 0 days.

(21) Appl. No.: 16/389,945

(22) Filed: Apr. 20, 2019

(65) Prior Publication Data

US 2019/0320776 A1 Oct. 24, 2019

Related U.S. Application Data

(60) Provisional application No. 62/660,826, filed on Apr. 20, 2018.

(51) Int. Cl.

| | |
|---|---|
| ***A45D 34/04*** | (2006.01) |
| ***A45D 40/26*** | (2006.01) |
| ***A45D 34/00*** | (2006.01) |

(52) U.S. Cl.

CPC ..... *A45D 34/045* (2013.01); *A45D 34/042* (2013.01); *A45D 40/262* (2013.01); *A45D 40/265* (2013.01); *A45D 2034/002* (2013.01)

(58) Field of Classification Search

CPC .... A45D 29/11; A45D 29/007; A45D 34/045; A45D 34/042; A45D 2034/002; A45D 29/004; A45D 29/18; A45D 40/042; A45D 40/26; A45D 34/048

See application file for complete search history.

(56) References Cited

U.S. PATENT DOCUMENTS

| | | | | |
|---|---|---|---|---|
| 1,659,383 | A | 2/1928 | Thiene et al. | |
| 2,633,845 | A * | 4/1953 | Peretti | A61H 7/003 401/129 |
| 4,917,520 | A | 4/1990 | Reid | |
| 5,115,930 | A * | 5/1992 | Lohrman | B65D 47/0838 215/227 |
| 7,051,907 | B2 | 5/2006 | Brincat | |
| 7,066,675 | B1 * | 6/2006 | Miller | A45D 29/007 401/126 |
| D650,302 | S | 12/2011 | Greubel et al. | |
| D772,579 | S | 11/2016 | Baranes | |
| D789,747 | S | 6/2017 | Hume | |
| 2005/0126584 | A1 | 6/2005 | Hsu | |
| 2005/0249539 | A1 * | 11/2005 | Habatjou | A46B 9/021 401/127 |
| 2010/0310297 | A1 * | 12/2010 | Gueret | A01N 59/16 401/129 |
| 2014/0069884 | A1 | 3/2014 | Paredes | |

* cited by examiner

*Primary Examiner* — David J Walczak

(74) *Attorney, Agent, or Firm* — Mark C. Johnson; Johnson Dalal

(57) ABSTRACT

A separable nail polish container having base with a paint material housed therein, a base cover selectively and removably coupled to the base portion, and an applicator brush selectively and removably coupled to the base cover. The base defines an upper opening of a diameter sufficient to allow refilling of a paint material, i.e., a more viscous gel or paint material, wherein the base cover can be removed to expose the upper opening. The applicator brush is insertable and removably within the base cover and includes a plurality of bristles spanning toward a bottom wall of the base.

18 Claims, 6 Drawing Sheets

SEPARABLE NAIL POLISH CONTAINER

CROSS-REFERENCE TO RELATED APPLICATION

This application claims priority to U.S. Provisional Patent Application No. 62/660,826 filed Apr. 20, 2018, the entirety of which is incorporated by reference.

FIELD OF THE INVENTION

The present invention relates generally to nail polish containers, and, more particularly, relates to nail polish containers operably configured to be enable mixing of gel polish therein and/or refilling.

BACKGROUND OF THE INVENTION

Nail polish is generally considered a lacquer that can be applied to human fingernails or toenails to decorate and protect the nail plates. The formulation has been revised repeatedly throughout the years to enhance its decorative effects, and to suppress cracking or flaking. Nail polish consists of a mix of an organic polymer and several other components, depending on the brand. Nail polish is pervasively used by many individuals across the world to express themselves or otherwise ornament their nails. As such, there are a variety of different colors, textures, and styles of nail polish available for use. Gel nail polish generally consists of methacrylate compounds and photo-initiating compounds, such as benzoyl peroxide. Unlike conventional nail polish, these mixtures aren't simply applied and left to dry. Instead gel polish is applied in layers which are exposed to ultraviolet light, thereby initiating a polymerization process which solidifies the polish. Many users desire to mix gel nail polish with paint polish, or otherwise insert a more viscous gel polish within a container.

One obvious disadvantage of prior manicuring polish containers is their openings, which are relatively small, making the inserting of any gel polish a messy and time-intensive process. A user could try to put conventional nail polish in the eyelet, and even glitter, or nail polish gel, but this is completely inefficient. A user would be forced to use syringes which were dangerous and could injure a user, particularly younger users trying to make glitter gel. The prior art required the use of funnels, and the funnel had a big surface area which kept all the nail polish and wasted most of it on the funnel instead of putting it into the bottle. The prior art bottle was overall inefficient and a hassle for a user. Moreover, many known polish containers do not have an applicator brush of a sufficient length that enables the brush to reach the bottom inside surface of the polish container.

Moreover, due to the amount of nail polish used in any one application and to keep the manufacturing costs down per bottle, nail polish is quickly exhausted, requiring a new bottle to be purchased. To that end, purchasing a new bottle of nail polish is generally required because re-filling the bottle is impractical or otherwise difficult in light of the size of the opening of the bottle. There are known re-fillable containers, but none of said known containers enable efficient and effective use of the container with respect to an applicator brush, namely a brush configured for use with an individual's nails.

Therefore, a need exists to overcome the problems with the prior art as discussed above.

SUMMARY OF THE INVENTION

The invention provides a separable nail polish container that overcomes the hereinafore-mentioned disadvantages of the heretofore-known devices and methods of this general type and that is configured for selective mixing or otherwise inserting gel polish therein. Said another way, the below-described polish container allows a user to clean the inside of the bottle, to insert a different nail polish, or to mix a glitter gel or nail polish gel inside of the bottle. The present invention is also advantageous over the known containers because it uses a long brush that extends all the way to the bottom of the bottle, so the user does not have to waste any nail polish.

With the foregoing and other objects in view, there is provided, in accordance with the invention, a separable nail polish container having a base with a bottom wall including a bottom outer surface and a bottom inner wall surface opposing the bottom outer surface. The base includes a sidewall surrounding the bottom wall and includes a sidewall outer surface, a sidewall inner surface, and an upper end defining an upper sidewall opening with an opening diameter, wherein the sidewall inner surface and bottom inner wall surface define a container cavity housing a paint material therein and having a maximum container cavity diameter, wherein the opening diameter at least 50% the maximum container cavity diameter. The assembly also includes a base cover having a lower sidewall selectively and removably coupled to the sidewall outer surface of the base in a threaded configuration, has an upper wall directly coupled to the lower sidewall of the base cover and covers the upper sidewall opening, and has an upper sidewall directly coupled to the upper wall of the base cover and defines an enclosed applicator channel. The assembly also includes an applicator brush having a handle portion with a top end and a bottom end opposing the top end of the applicator brush, wherein the handle portion has an applicator stem coupled thereto that extends passed the bottom end of the handle portion, is disposed within the enclosed applicator channel, and includes a distal end with a plurality of bristles coupled thereto. The handle portion is also selectively and removably coupled to the upper sidewall in a threaded configuration.

In accordance with a further feature of the present invention, the bottom inner wall surface is of a concave shape and the opening diameter is at least 80% the maximum container cavity diameter.

In accordance with another feature, an embodiment of the present invention includes the bottom outer surface having an enclosed recess disposed thereon, wherein the bottom outer surface is of a spherical shape.

In accordance with an additional feature of the present invention, the upper sidewall of the base cover is disposed in an orthogonal orientation with respect to an upper surface of the upper wall. In other embodiments, the upper sidewall of the base cover is disposed in an upright orientation with respect to an upper surface of the upper wall.

In accordance with yet another feature of the present invention, the base, the base cover, and the applicator brush are selectively and removably coupled to one another in a watertight configuration.

In accordance with a further feature, an embodiment of the present invention also includes the plurality of bristles having a distal end disposed proximal to the bottom inner wall surface of the bottom wall.

In accordance with an additional feature, an embodiment of the present invention also includes the lower sidewall and/or the upper wall of the base further having a friction-inducing material disposed thereon.

In accordance with an additional feature, an embodiment of the present invention also includes an annular-shaped paint barrier disposed on the upper surface of the upper wall, wherein the annular-shaped paint barrier defines, with the handle portion of the applicator brush, an annular-shaped channel surrounding the handle portion of the applicator brush.

In accordance with a further feature, an embodiment of the present invention also includes the handle portion of the applicator brush having a labeling member selectively and removably coupled and frictionally retained thereto.

With the foregoing and other objects in view, there is provided, in accordance with the invention, a separable nail polish container having a base with a bottom wall including a bottom outer surface and a bottom inner wall surface opposing the bottom outer surface. The assembly also includes a sidewall surrounding the bottom wall and including a sidewall outer surface, a sidewall inner surface, and an upper end defining an upper sidewall opening, wherein the sidewall inner surface and bottom inner wall surface defines a container cavity. The assembly also includes a base cover having a lower sidewall selectively and removably coupled to the sidewall outer surface of the base in a watertight configuration, has an upper wall directly coupled to the lower sidewall of the base cover and covers the upper sidewall opening, and has an upper sidewall directly coupled to the upper wall of the base cover and defining an enclosed applicator channel. The assembly also includes an applicator brush having a handle portion with a top end and a bottom end opposing the top end of the applicator brush, wherein the applicator brush has an applicator stem coupled thereto that extends passed the bottom end of the handle portion and is disposed within the enclosed applicator channel. The applicator brush includes a distal end with a plurality of bristles coupled thereto, each having a distal end disposed proximal to the bottom inner wall surface of the bottom wall, wherein the handle portion selectively and removably coupled to the upper sidewall in a watertight configuration.

In accordance with yet another feature of the present invention, the distal end of the plurality of bristles coupled are disposed proximal to the bottom outer wall surface of the bottom wall.

Although the invention is illustrated and described herein as embodied in a re-fillable nail polish container, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the nail polish container, i.e., from a top end to a bottom end of the container.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 2:
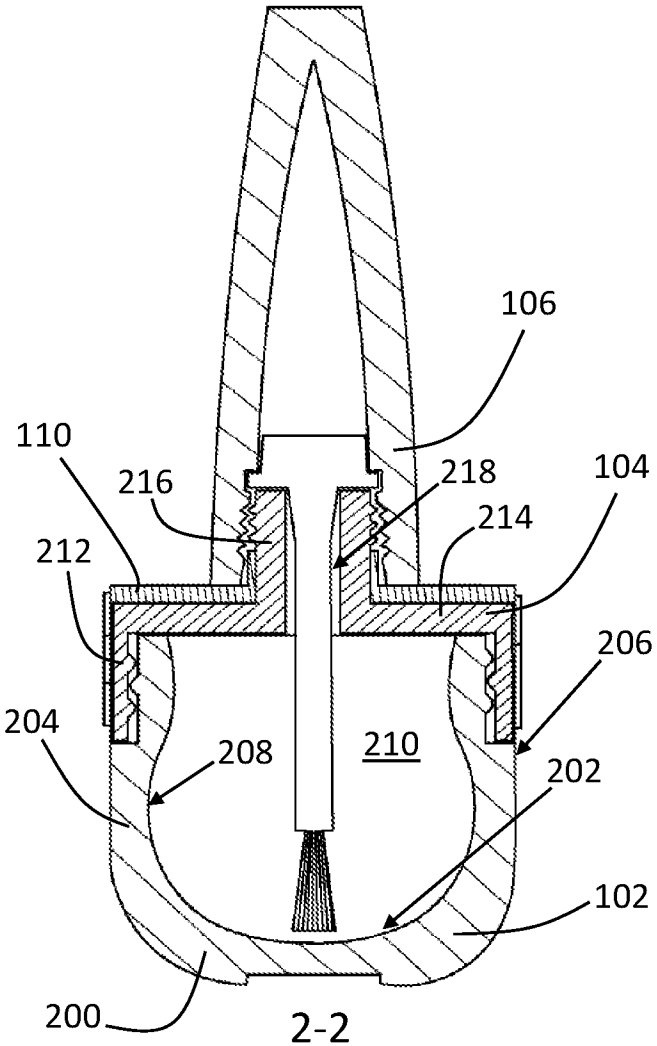
FIG. 2 is a cross-section view along section line 2-2 depicted in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 1:
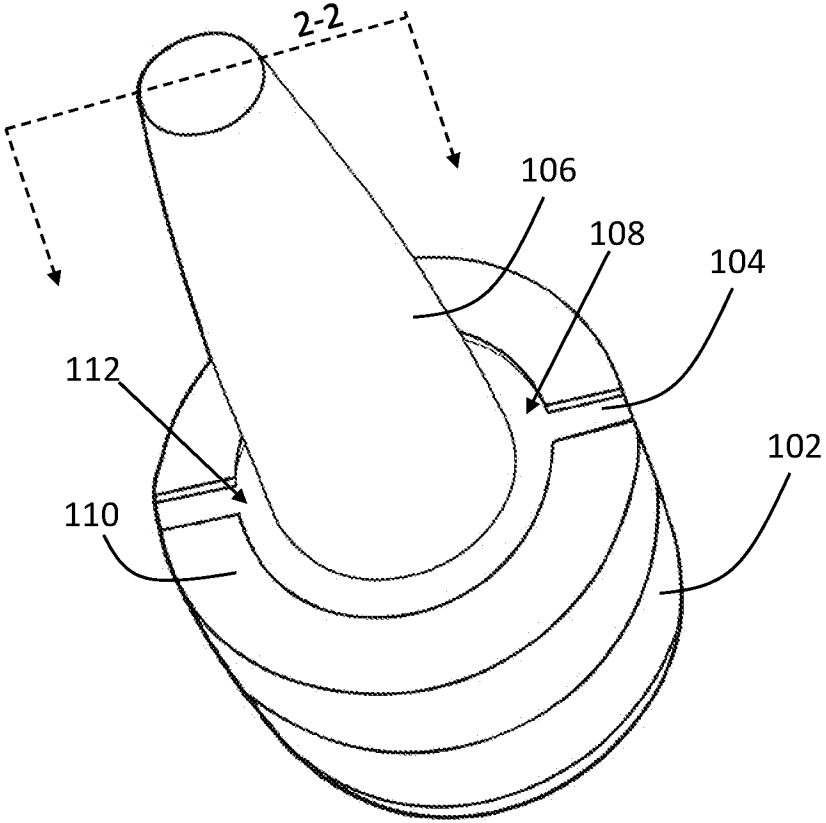
FIG. 1 is a perspective view of a separable nail polish container in accordance with one embodiment of the present invention.

The present invention provides a novel and efficient separable nail polish container with an applicator brush disposed therein for applying a nail polish or paint material to one or more of user's nails. Referring now to FIGS. 1-2, one embodiment of the present invention is shown in a perspective and cross-section view, respectively. The figures depicted herein show several advantageous features of the present invention, but, as will be described below, the invention can be provided in several shapes, sizes, combinations of features and components, and varying numbers and functions of the components. The first example of a separable nail polish container 100, as shown in FIGS. 1-2, includes a base 102, a base cover 104, and an applicator brush 106 all selectively and removably coupled to one another for effective and efficient mixing of a paint or gel material (generally referred to herein as "paint"). In one embodiment, the base 102, base cover 104, and applicator member 106 are all rotatably and removably coupled to one another.

The base 102, which is preferably of a durable, thick, and transparent glass material, includes a bottom wall 200 with a bottom outer surface 500 (shown best in FIG. 5) and a bottom inner wall surface 202, wherein the bottom inner wall surface 202 opposes the bottom outer surface 500. The base 102 may also be of another polymeric, ceramic, or material that is substantially rigid. The bottom wall 200 of the base 102 may also be of a thickness greater than the thickness of the other parts of the base 102 in order to weight the container to maintain the base 102 in an upright orientation with respect to a ground surface.

Figure 4:
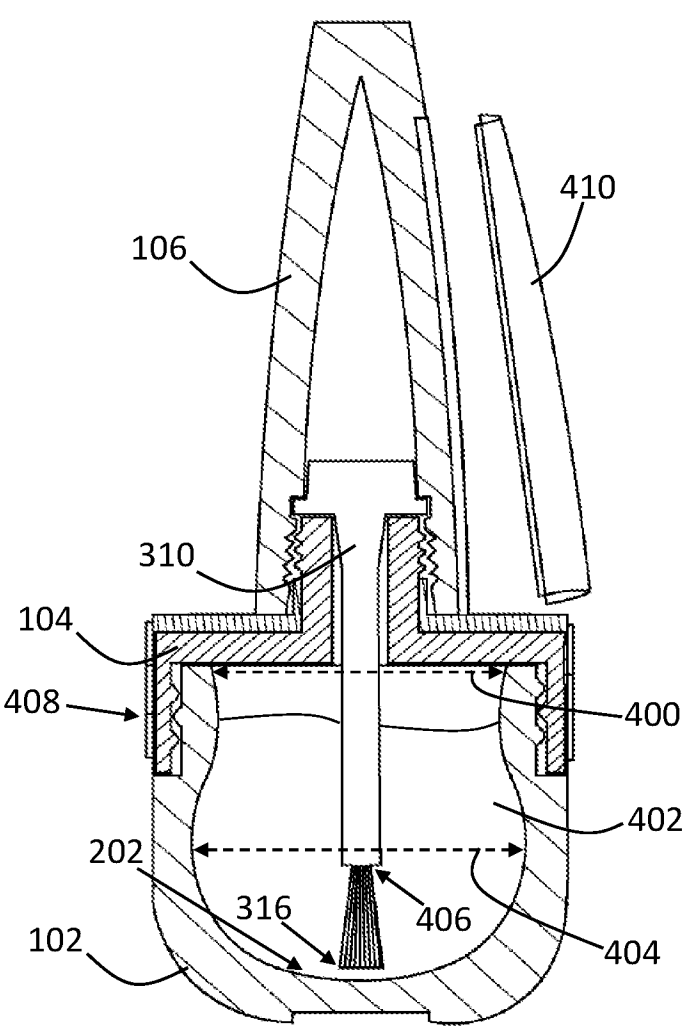
FIG. 4 is a cross-section view along section line 2-2 depicted in FIG. 1 with a labeling member shown in an exploded view and with a paint material disposed within the separable nail polish container.
Figure 3:
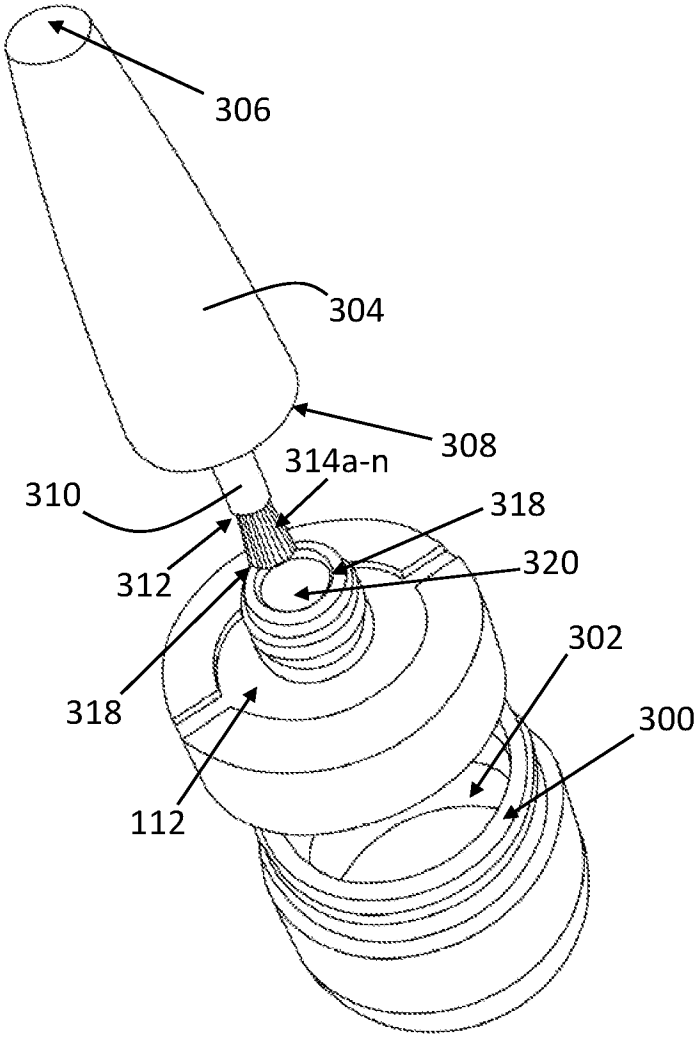
FIG. 3 is an exploded view of the separable nail polish container depicted in FIG. 1.

With specific reference to FIGS. 2-4, the base 102 also includes a sidewall 204 surrounding or enclosing the bottom wall 200. The sidewall 204 includes a sidewall outer surface 206, a sidewall inner surface 208, and an upper end 300. The upper end 300 can be seen defining an upper sidewall opening 302 with an opening diameter 400. The sidewall inner surface 208 and bottom inner wall surface 202 define a container cavity 210 that is configured to house a paint material 402 therein. It should be understood that terms such as, "front," "rear," "side," top," "bottom," and the like are indicated from the reference point of a viewer viewing the container assembly 100. As used herein, the term "wall" is intended broadly to encompass continuous structures, as well as, separate structures that are coupled together to form a substantially continuous surface.

In one embodiment, the paint material 402 may be of a film-forming polymer dissolved in a volatile organic solvent, e.g., nitrocellulose that is dissolved in butyl acetate or ethyl acetate. Additional additives or agents may be added, however, e.g., plasticizers such as dibutylphthalate and camphor to yield non-brittle films, dyes and pigments, stearalkonium hectorite, mica, bismuth oxychloride, natural pearls, and aluminum powder, and adhesive polymers, among others known by those of skill in the art.

Beneficially, the container cavity 210 includes a maximum container cavity diameter 404 where the paint material, or the like, is poured therein and through the upper sidewall opening 302. In one embodiment, the opening diameter 400 is at least 50% the maximum container cavity diameter 404. In other embodiments, the opening diameter 400 is at least 75-100% the maximum container cavity diameter 404 to enable easy filling of the cavity 210. For example, in one embodiment, the sidewall inner surface 208 is circular or rectangular in shape and has a maximum diameter 404 of approximately 1-2 inches, wherein the diameter 400 of the opening 302 is approximately 0.75-1.5 inches. The bottom inner wall surface 202 may also be of a concave shape to effectively enable pooling of the paint material housed therein and for enabling the applicator 106 to effectively utilize the paint material 402.

The assembly 100 also includes a base cover 104 having a lower sidewall 212 selectively and removably coupled to the sidewall outer surface 206 of the base 102 in a threaded and/or watertight configuration. The threaded configuration may also include a tongue-and-groove configuration in some embodiments. The base cover 104 also includes an upper wall 214 directly coupled to the lower sidewall 212 of the base cover 104 and is sized and shaped to cover the upper sidewall opening 302. The base cover 104 also includes an upper sidewall 216 directly coupled to the upper wall 214 of the base cover 104 and defines an enclosed applicator channel 218 wherein an applicator stem 310 of the applicator 106 may be inserted and/or disposed therein for accessing the opening 302 and cavity 210. Said another way, the upper wall 214 may include a protruding male member 216 operably configured to couple with the applicator member 106. In one embodiment, the upper sidewall 216 of the base cover 104 is disposed in an orthogonal orientation with respect to an upper surface 108 of the upper wall 214. Said differently, the upper sidewall 216 of the base cover 104 may also be disposed in an upright orientation with respect to an upper surface 108 of the upper wall 214 to enable effective and efficient removal and tightening of the applicator brush 106 with respect to the base cover 104. The sidewalls 212, 216 and upper wall 214 may be one unitary piece of material or formed from individual components coupled together.

The applicator brush 106 includes a handle portion 304, which may be elongated as shown in the figures, wherein the handle portion 304 includes a top end 306 and a bottom end 308 opposing the top end 306 of the applicator brush 106. The applicator brush 106 also includes an applicator stem 310 coupled thereto. The applicator stem 310 may be cylindrical and may be friction fitted within the handle portion 304. The applicator stem 310 extends passed the bottom end 308 of the handle portion 304, is disposed within the enclosed applicator channel 218, and includes a distal end 312 with a plurality of bristles 314*a-n* coupled thereto, wherein "n" represents any number greater than one. The plurality of bristles 314*a-n* may be of a polymeric fiber material or other known material and coupling configuration with respect to the stem. Similar to the coupling configuration of the base 102 and the base cover 104, the handle portion 304 may also be selectively and removably coupled to the upper sidewall 216 in a threaded and/or water tight configuration.

As best seen in FIG. 2 and FIG. 4, the plurality of bristles 314*a-n* also include a distal end 316, opposite a first end 406 coupled to the stem 310, disposed proximal to the bottom inner wall surface 202 of the bottom wall 200. More specifically, the stem 310 and/or plurality of bristles 314*a-n*, which are all generally oriented in the longitudinal direction, are sized so that the distal end 316 of each of the plurality of bristles 314*a-n* are touching, directly adjacent to, or within approximately 0.1 inches of the bottom inner wall surface 202. In some embodiments, the distal end 316 of each of the plurality of bristles 314*a-n* is also substantially proximal to the bottom outer surface 500 of the bottom wall 200, i.e., within approximately 0.2-0.4 inches from, thereby minimizing the overall size of the assembly 100.

Figure 5:
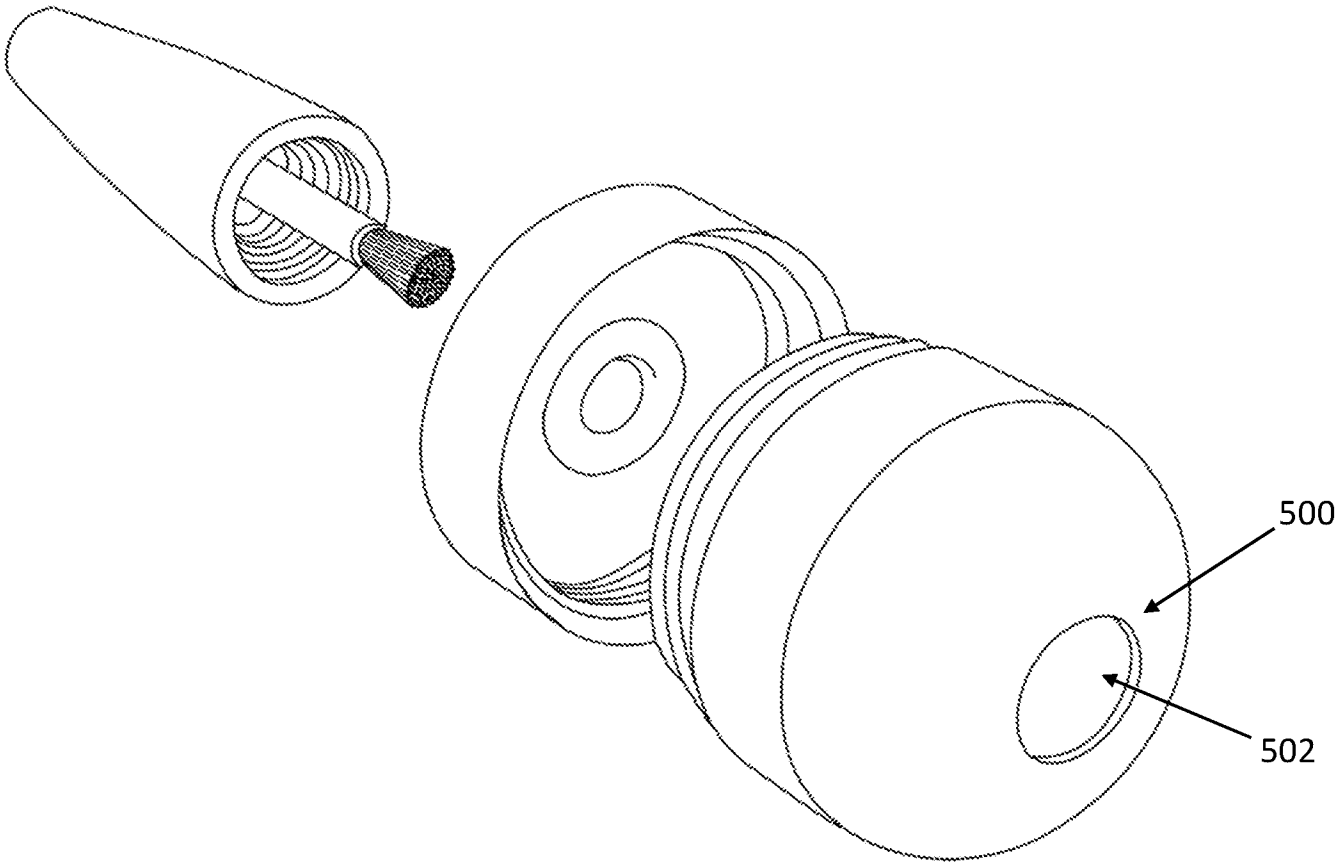
FIG. 5 is an exploded view of the separable nail polish container depicted in FIG. 1 from a bottom-end perspective.
Figure 7:
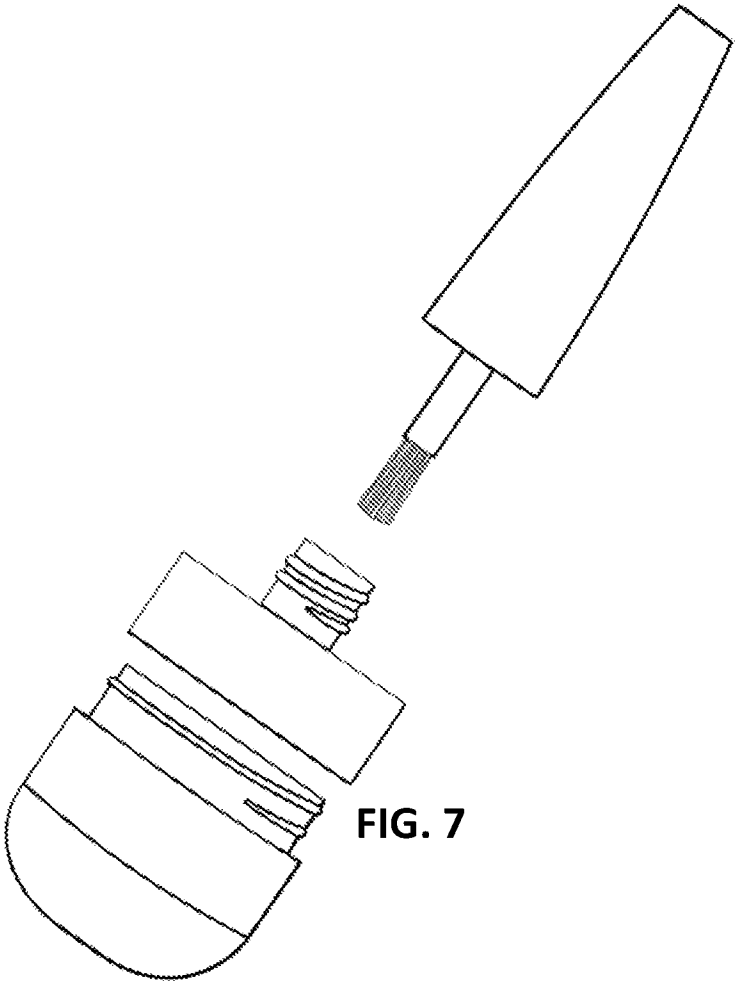
FIG. 7 is an elevational and exploded side view of the separable nail polish container depicted in FIG. 1.
Figure 6:
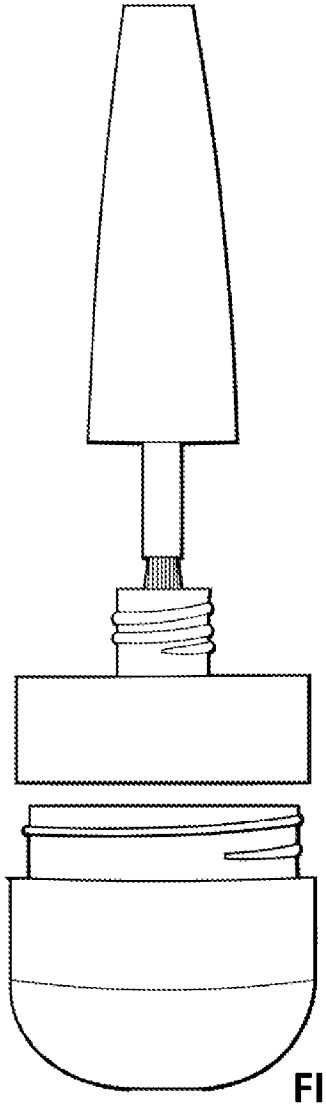
FIG. 6 is an elevational and partially exploded side view of the separable nail polish container depicted in FIG. 1.
Figure 9:
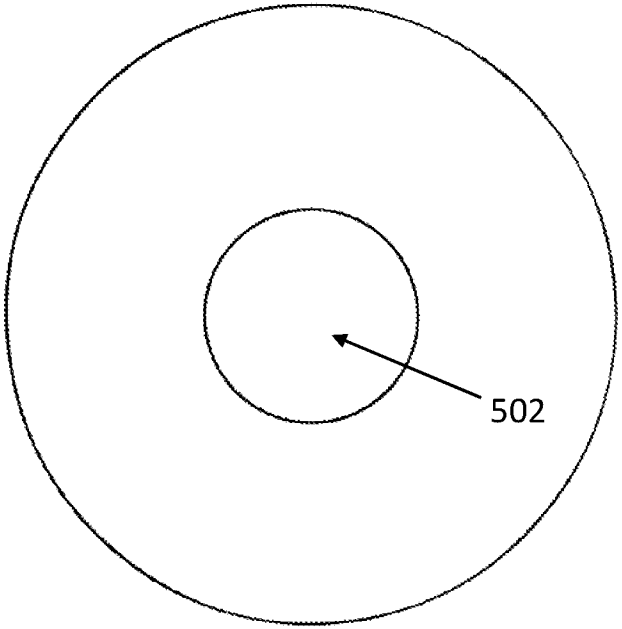
FIG. 9 is a bottom plan view of the separable nail polish container depicted in FIG. 1.
Figure 8:
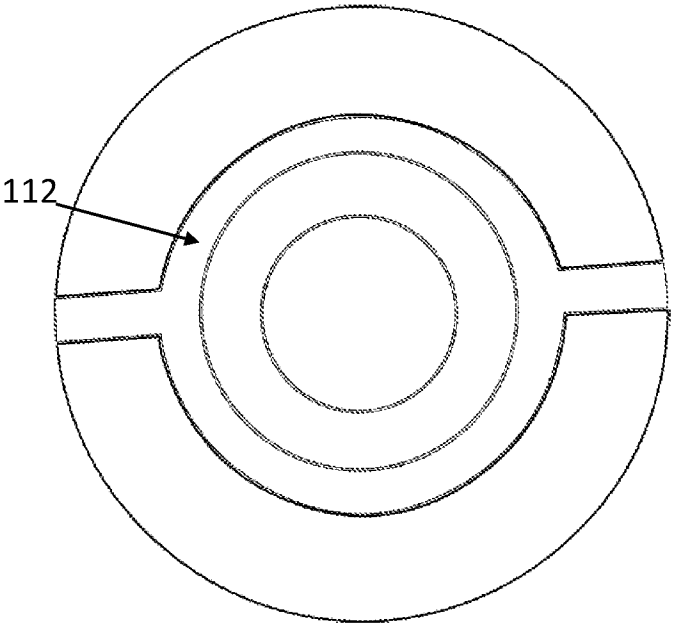
FIG. 8 is a top plan view of the separable nail polish container depicted in FIG. 1.

With reference to FIGS. 4-5, the bottom outer surface 500 may be of a spherical shape to provide comfort to the user in holding or otherwise handling the base 102. The bottom outer surface 500 may also include an enclosed recess 502 disposed thereon for facilitating in handling or grasping the base 102 effectively. With reference briefly to FIG. 2 and FIG. 4, either or both of the lower sidewall 212 and upper wall 214 of the base 102 may also include a friction-inducing material disposed thereon, e.g., a rubber or otherwise abrasive material 408. Further, with reference to FIG. 2, the upper wall 214 of the base cover 104 can be seen extending perpendicular to the terminal end of the lower sidewall 212 and the upper sidewall 216 of the base cover 104 can be seen extending perpendicular to the upper wall 214 lower sidewall 212 until defining a portion of an enclosed applicator channel 218. Said another way, the upper wall 214 is disposed in a perpendicular orientation with respect to the lower sidewall orientation. The upper surface 108 of the upper wall 214 can also be seen as being substantially planar with the annular-shaped channel 112 coupled thereto.

With reference to FIGS. 1-3 and FIG. 8, the upper surface 108 of the upper wall 214 may include an annular-shaped paint barrier 110 disposed thereon, e.g., adhesively or mechanically fastened thereto. The annular-shaped paint barrier 110 may also define, with the handle portion 304 of the applicator brush 106, an annular-shaped channel 112 surrounding the handle portion 304. The annular-shaped paint barrier 110 may be of a metallic material, e.g., aluminum, and may of a minimal height, e.g., approximately 0.01-0.2 inches, to prevent overrun paint from an upper end 318 of the upper sidewall 216 or the plurality of bristles 314*a-n* from flowing over the outer surfaces of the base cover 104 or the base 102. The upper end 318 may also define an opening 320 shaped and sized to receive the plurality of bristles 314*a-n* and stem 310. In one embodiment, the opening 320 and channel 218 are sized to be slightly larger than the maximum diameter of the collective plurality of bristles 314*a-n* and the stem 310.

Figure 10:
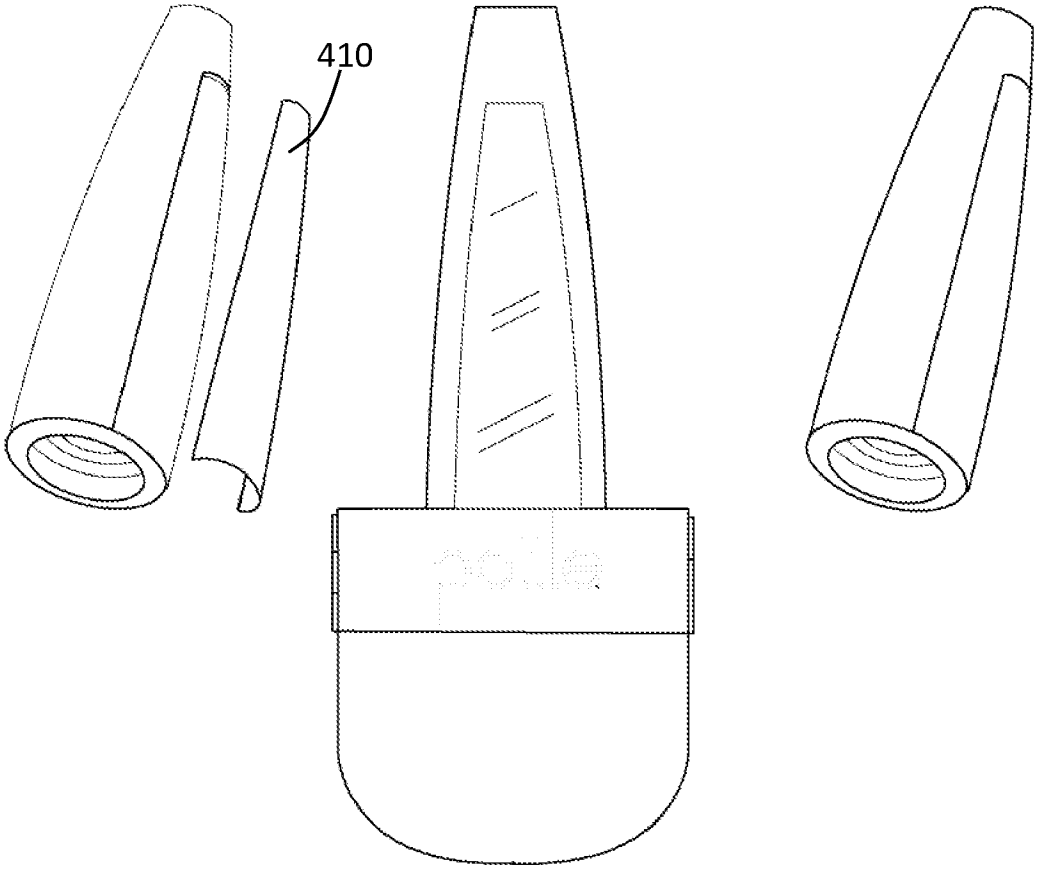
FIG. 10 is a partially exploded view of the separable nail polish container depicted in FIG. 1.

As best seen in FIG. 4 and FIG. 10, the handle portion 304 of the applicator brush 106 has a labeling member 410 selectively and removably coupled and frictionally retained thereto. As the container 100 is beneficially configured to be refilled by the user, the labeling member 410 may be removed for inscribing the type, class, or color of paint material housed within the base 102. The labeling member 410 may be of a flexible polymeric material, e.g., ABS plastic, that enables the user to write an indicia thereon with a writing tool, e.g., pen. The outer perimeter of the labeling member 410 may be operably configured to join or directly couple with a wall defining a recess on the handle portion 304 of the applicator brush 106. This may include, for example, a tongue-and-groove configuration. In other embodiments, other portions of the assembly 100 may be removed for inscribing, or one or more outer surfaces of the base 102, base cover 104, or handle portion 304 may be configured for the user to inscribe an indicia thereon.

With reference to FIGS. 5-9, one exemplary process of using the assembly will be described. Although a specific order of executing the process steps is described, the order of executing the steps may be changed relative to the order shown in certain embodiments. Also, two or more steps may be executed concurrently or with partial concurrence in some embodiments. Certain steps may also be omitted for the sake of brevity. In some embodiments, some or all of the process steps included or described can be combined into a single process.

More specifically, in one embodiment, the base may be empty, thereby requiring the user to rotate, e.g., counter clockwise, the base cover to access the opening. Then, the user may insert a paint material, i.e., a viscous gel or paint, within the base and base cavity and place the base cover on the top of the based and rotate in the opposite direction, e.g., clockwise. The closing of the base cover over the base encapsulates the paint material. Thereafter, when desired for use, the user will then unscrew or rotate the applicator brush handle to remove the stem and plurality of bristles, which are covered with the paint material, i.e., paint or gel material. The user will then utilize the applicator brush as known by those of skill in the art. When finished, the user will then screw or rotate the applicator brush back on the base cover. The user will then repeat the above-describe steps to refill the base with a paint material.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A separable nail polish container comprising:

a base having:

a bottom wall with a bottom outer surface and a bottom inner wall surface opposing the bottom outer surface; and a sidewall surrounding the bottom wall and including a sidewall outer surface, a sidewall inner surface, and an upper end defining an upper sidewall opening with an opening diameter, the sidewall inner surface and bottom inner wall surface defining a container cavity housing a paint material therein and having a maximum container cavity diameter, the opening diameter at least 50% the maximum container cavity diameter;

a base cover having a lower sidewall selectively and removably coupled to the sidewall outer surface of the base in a threaded configuration and terminating at a terminal end, having an upper wall directly coupled to the lower sidewall of the base cover at the terminal end of the lower sidewall and disposed in a perpendicular orientation with respect to the lower sidewall until defining a portion of an enclosed applicator channel and covering the upper sidewall opening, and having an upper sidewall directly coupled to the upper wall of the base cover and defining the remainder of the enclosed applicator channel wherein the enclosed applicator channel extends above the upper wall of the base cover without extending below the upper wall of the base cover; and an applicator brush having a handle portion with a top end and a bottom end opposing the top end of the handle portion of the applicator brush, the handle portion of the applicator brush having an applicator stem coupled thereto, extending passed the bottom end of the handle portion, disposed within the enclosed applicator channel, and including a distal end with a plurality of bristles coupled thereto, the handle portion selectively and removably coupled to the upper sidewall of the base cover in a threaded configuration.

2. The separable nail polish container according to claim 1, wherein:

the bottom inner wall surface is of a concave shape.

3. The separable nail polish container according to claim 1, wherein the bottom outer surface further comprises:

an enclosed recess disposed thereon, wherein the bottom outer surface is of a spherical shape.

4. The separable nail polish container according to claim 1, wherein:

the upper sidewall of the base cover is disposed in an orthogonal orientation with respect to an upper surface of the upper wall.

5. The separable nail polish container according to claim 1, wherein:

the upper sidewall of the base cover is disposed in an upright orientation with respect to an upper surface of the upper wall.

6. The separable nail polish container according to claim 1, wherein:

the base, the base cover, and the applicator brush are selectively and removably coupled to one another in a watertight configuration.

7. The separable nail polish container according to claim 1, wherein the plurality of bristles further comprises:

a distal end disposed proximal to the bottom inner wall surface of the bottom wall.

8. The separable nail polish container according to claim 1, wherein at least one of the lower sidewall and upper wall of the base cover further comprises:

a friction-inducing material disposed thereon.

9. The separable nail polish container according to claim 1, further comprising:

an annular-shaped paint barrier disposed on an upper surface of the upper wall of the base cover, the annular-shaped paint barrier defining, with the handle portion of the applicator brush, an annular-shaped channel surrounding the handle portion of the applicator brush.

10. The separable nail polish container according to claim 1, wherein the handle portion of the applicator brush further comprises:

a labeling member selectively and removably coupled and frictionally retained thereto.

11. A separable nail polish container comprising:

a base having:

a bottom wall with a bottom outer surface and a bottom inner wall surface opposing the bottom outer surface; and a sidewall surrounding the bottom wall and including a sidewall outer surface, a sidewall inner surface, and an upper end defining an upper sidewall opening, the sidewall inner surface and bottom inner wall surface defining a container cavity;

a base cover having a lower sidewall selectively and removably coupled to the sidewall outer surface of the base in a watertight configuration and terminating at a terminal end, having an upper wall directly coupled to the lower sidewall of the base cover at the terminal end of the lower sidewall and disposed in a perpendicular orientation with respect to the lower sidewall until defining a portion of an enclosed applicator channel and covering the upper sidewall opening, and having an upper sidewall directly coupled to the upper wall of the base cover and defining the remainder of the enclosed applicator channel wherein the enclosed applicator channel extends above the upper wall of the base cover without extending below the upper wall of the base cover; and an applicator brush having a handle portion with a top end and a bottom end opposing the top end of the handle portion of the applicator brush, the handle portion of the applicator brush having an applicator stem coupled thereto, extending passed the bottom end of the handle portion, disposed within the enclosed applicator channel, and including a distal end with a plurality of bristles coupled thereto, each having a distal end disposed proximal to the bottom inner wall surface of the bottom wall, the handle portion selectively and removably coupled to the upper sidewall in a watertight configuration.

12. The separable nail polish container according to claim 11, wherein:

the distal end of the plurality of bristles coupled thereto, each having are disposed proximal to the bottom outer wall surface of the bottom wall.

13. The separable nail polish container according to claim 11, wherein:

the upper sidewall opening of the upper end includes an opening diameter; and the container cavity includes a maximum container cavity diameter, wherein the opening diameter is at least 50% the maximum container cavity diameter.

14. The separable nail polish container according to claim 13, wherein:

the opening diameter is at least 80% the maximum container cavity diameter.

15. The separable nail polish container according to claim 11, wherein:

the container cavity houses a paint material therein.

16. The separable nail polish container according to claim 11, wherein:

the lower sidewall of the base cover is selectively and removably coupled to the sidewall outer surface of the base in a threaded configuration; and the handle portion of the applicator brush is selectively and removably coupled to the upper sidewall of the base cover in a threaded configuration.

17. The separable nail polish container according to claim 11, wherein:

the bottom inner wall surface is of a concave shape.

18. The separable nail polish container according to claim 1, wherein:

the upper sidewall of the base cover is disposed in an orthogonal orientation with respect to an upper surface of the upper wall.

* * * * *